United States Patent [19]

Robertson et al.

[11] Patent Number: 4,903,954

[45] Date of Patent: Feb. 27, 1990

[54] SHEET TRANSPORTING APPARATUS

[75] Inventors: Atholl A. Robertson, Ridgefield; William G. Hart, Jr., Stamford, both of Conn.

[73] Assignee: Pitney Bowes Inc., Stamford, Conn.

[21] Appl. No.: 193,311

[22] Filed: May 11, 1988

Related U.S. Application Data

[63] Continuation-in-part of Ser. No. 128,015, Dec. 2, 1987, Pat. No. 4,821,049.

[51] Int. Cl.[4] ..... B65H 5/02

[52] U.S. Cl. ..... 271/7; 271/273; 271/274; 346/134; 346/139 A

[58] Field of Search ..... 271/3, 7, 264, 272, 271/273, 274; 346/134, 139 R, 139 A

[56] References Cited

U.S. PATENT DOCUMENTS 3,924,847 12/1975 Pescetto ..... 271/3

FOREIGN PATENT DOCUMENTS 38292 3/1977 Japan ..... 271/274
211283 12/1983 Japan ..... 271/264
7155 1/1986 Japan ..... 271/272

*Primary Examiner*—Kevin P. Shaver

*Assistant Examiner*—David H. Bollinger

*Attorney, Agent, or Firm*—Donald P. Walker; Melvin J. Scolnick; David E. Pitchenik

[57] ABSTRACT

Apparatus is provided for transporting a sheet in a predetermined path of travel. The apparatus comprises a plate having a lower surface extending parallel to and defining the path of travel, and having an aperture formed therein. In addition, the apparatus comprises sheet feeding structure, including a first pair of rollers spaced apart from one another and an endless belt looped about the first rollers, wherein the belt has a lower belt run extending between the first rollers and beneath the plate. Further, the feeding structure includes instrumentalities for driving one of the first rollers for moving the lower belt run at a constant velocity in the direction of the path of travel. Moreover, the feeding structure includes a second pair of rollers which are disposed beneath the plate and are made of a compliant material. Still further, the feeding structure includes structure for resiliently urging the compliant rollers toward the path of travel for urging a sheet feed to the apparatus into contact with the belt and the lower surface of the plate, whereby the belt engages and feeds the sheet at a constant velocity with a portion thereof in the path of travel when fed past the aperture.

22 Claims, 3 Drawing Sheets

SHEET TRANSPORTING APPARATUS

This application is a continuation-in-part of U.S. patent application Ser. No. 128,015, now U.S. Pat. No. 4,821,049, for a Substrate Transport System, filed Dec. 2, 1987 by John K. Eckl and assigned to the assignee of the present invention; the subject matter of which is hereby incorporated in this application by reference.

BACKGROUND OF THE INVENTION

This invention is generally concerned with apparatus for transporting sheets and more particularly such apparatus including means for registering a surface of a moving sheet against a surface of a plate.

When sheet transporting apparatus is used in combination with structures for reading or writing information on different sizes and shapes of envelopes, the apparatus preferably includes structures for registering both an edge and a surface of the sheet, to enhance the quality of the information which is to be written on the sheet, or to reduce the error rate in reading information from the sheet, or both, as the case may be. In addition, such apparatus is preferably adapted for transporting the sheets at a constant velocity.

A more detailed discussion of the aforesaid subject matter and exemplary embodiments of apparatus for providing edge and surface registration of sheets and envelopes while feeding the same beneath reading and writing structures may be found in the aforesaid Patent Application.

The present invention is concerned with the provision of an improvement in the aforesaid transporting apparatus exemplified by the embodiments shown in the aforesaid patent application. Accordingly:

an object of the invention is to provide improved sheet transporting apparatus;

another object is to provide sheet and letter transporting apparatus including sheet and letter feeding means; and, another object is to provide sheet transporting apparatus including means for registering the top surface of an envelope against a plate surface.

SUMMARY OF THE INVENTION

Apparatus for transporting a sheet in a predetermined path of travel, the apparatus comprising: a plate having a lower surface extending parallel to the path of travel, the plate including an aperture; sheet feeding means including a first pair of rollers spaced apart from one another and an endless belt looped about the first rollers, the belt having a lower belt run extending between the first rollers and beneath the plate for engaging a sheet fed thereto, the feeding means including means for driving one of the first rollers for moving the lower belt run in the path of travel, the feeding means including a second pair of rollers disposed beneath the plate, each of the second rollers being made of a compliant material, and the transporting means including means for resiliently urging the compliant rollers toward the path of travel for urging a sheet fed to the apparatus into contact with the belt and plate such that the belt engages the sheet and feeds a portion of the sheet in the path of travel past the aperture.

BRIEF DESCRIPTION OF THE DRAWINGS

As shown in the drawings wherein like reference numerals designate like or corresponding parts.

DESCRIPTION OF THE PREFERRED EMBODIMENTS

Figure 1:
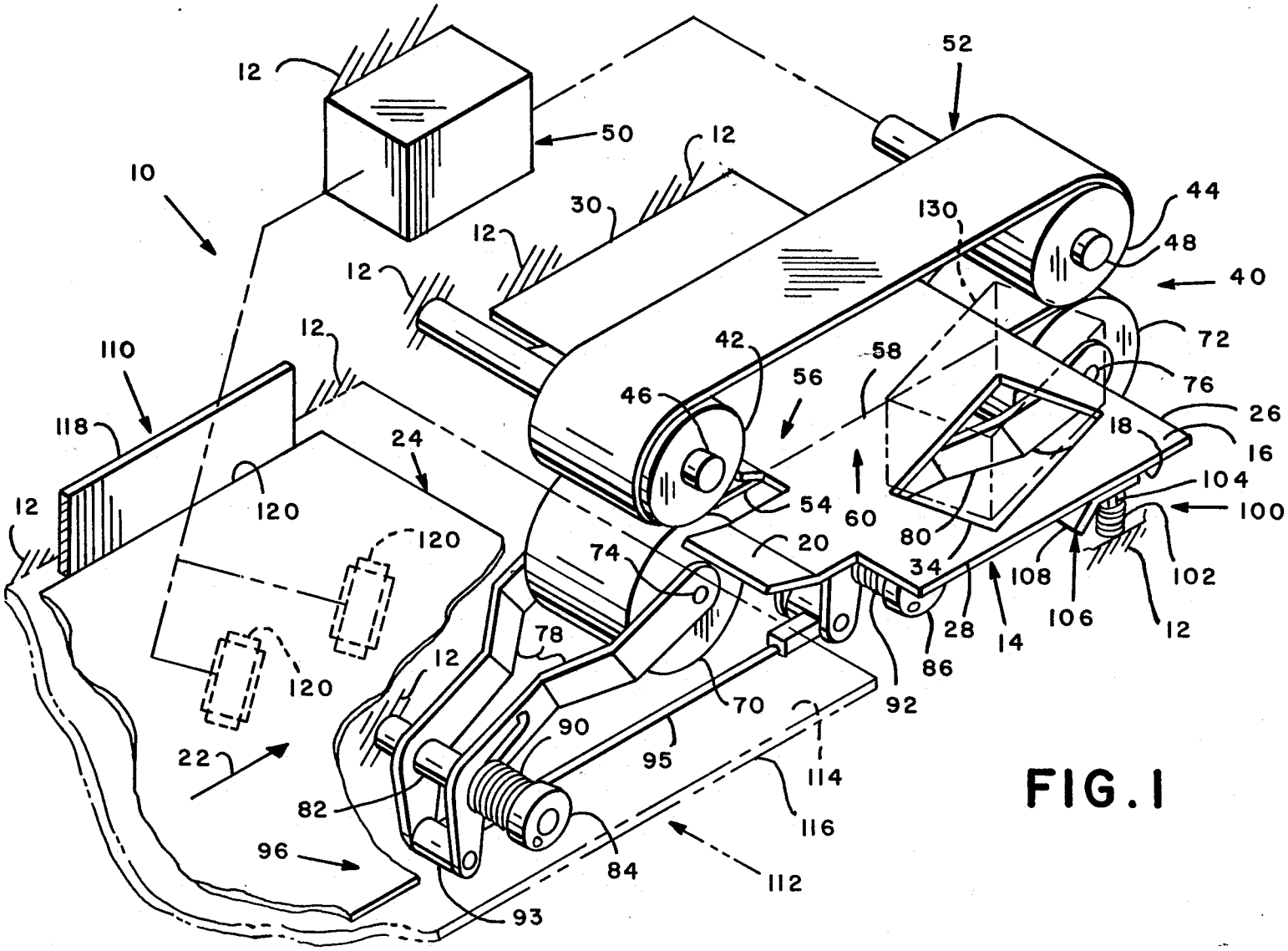
FIG. 1 is a perspective view of apparatus according to the invention.

As shown in FIG. 1, sheet transporting apparatus 10 includes conventional framework 12 for supporting the various components of the apparatus 10, including a horizontally extending guide plate 14 having upper and lower flat surfaces respectively designated 16 and 18. Further, the guide plate 14 includes a forward marginal edge 20 which extends both upstream and upwardly of the direction of travel 22 of a sheet or letter 24 fed to the apparatus 10 and includes a rear marginal edge 26 which extends downstream of the path of travel 22. Moreover, the guide plate 14 includes a first side edge 28 extending outwardly of the apparatus 10 and a second side edge 30 which extends inwardly of the apparatus 10 and is conventionally connected to the framework 12. In addition, the guide plate 14 includes a generally rectangularly-shaped aperture 34 which is formed in the plate 14 between the forward and rear marginal edges 20 and 26.

The transporting apparatus 10 (FIG. 1) additionally includes feeding structure generally designated by the numeral 40. The feeding structure 40 includes a first pair of forward and rear rollers, 42 and 44 which are spaced apart from one another and mounted on a first pair of parallel-spaced forward and rear shafts 46 and 48 located above the guide plate 14. The rear roller shaft 48 is conventionally connected to a source of supply of motive power 50 for driving the roller 44 at a constant velocity. The feeding structure 40 additionally includes a flexible belt 52 which is conventionally looped about the rollers 42 and 44 for engagement therewith. The belt 52 has a lower belt run 54 which extends between the rollers 42 and 44 and beneath the guide plate 14 such that the belt run 54 is spaced apart from and disposed inwardly of the plate aperture 34. Thus, the belt run 54 engages a portion 56 of the plate 14, generally lying inwardly of a centerline 58 extending between the belt 52 and aperture 34, whereas the plate aperture 34 is formed in a portion 60 of the guide plate 14, generally lying outwardly of the centerline 58.

The feeding structure 10 (FIG. 1) additionally includes a second pair of forward and rear rollers 70 and 72 which are spaced apart from one another and mounted on a second pair of parallel-spaced, forward and rear shafts 74 and 76 located below the guide plate 14. The rollers 70 and 72 are preferably made of a compliant, porous material, such as urethane rubber, which is resiliently yieldable under compression. In addition, the feeding structure 40 includes a pair of forward and rear yoke members 78 and 80, which are spaced apart from one another and located beneath the plane of the guide plate 14. The second rollers 70, 72 and roller shafts 74, 76, are conventionally rotatably connected to the upper ends of the respective yoke members 78 and 80, on a one-for-one basis, for rotation relative thereto. Further, the feeding structure 40 includes a third pair of spaced-apart shafts 82, one of which is shown, which are conventionally connected to the framework 12 and located beneath the guide plane of the plate 14. The lower ends of the respective yokes 78 and 80 are conventionally rotatably connected to the shafts 82 on a one-for-one basis. Moreover, the feeding structure 40 includes a pair of annularly-shaped stops 84 and 86, which are fixedly mounted on a one-for-one basis on the outwardly extending ends of the shafts 82, and a pair of coil springs 90 and 92, which are conventionally mounted around each of the shafts 82 between the yoke 78 or 80 and stop 84 and 86, with which the spring 90 or 92 is associated. Each of the spring 90, 92 has one end connected to its associated stop 84 or 86, as the case may be, and the other end connected to its associated yoke 78 or 80, as the case may be, for urging the associated yokes 74 and 76, and thus the roller 70, 72, in unison with one another toward the plane of the guide plate 14.

Each of the yokes 74, 76 (FIG. 1) also includes a conventional bearing bushing 93, one of which is shown, which is suitably rotatably connected to the lower end of each yoke 74, 76. Further, the feeding structure 40, includes an elongate, horizontally extending, tie rod 95 which is conventionally connected to the respective bearing bushings 93 for constraining movement of the yokes 78, 80 to movement in unison with one another both toward the plane of the guide plate 14, under the influence of the springs 90, 92 and away from the plane of the plate 14, against the compression of the springs 90, 92.

For guiding the respective outer marginal edges, generally designated by the numeral 96, of sheets or letters 24 of various thickness and shapes through the apparatus 10. The apparatus 10 preferably includes a spring structure 100 located beneath the outwardly extending end of the guide plate 14, preferably near the plate aperture 34 for urging respective sheets and letters 24 into contact with the lower surface of the guide plate 14. Preferably, the spring structure 100 includes a compression spring 102 held in place by a post 104 which is fixedly connected to the framework 12. The spring 102 has one end conventionally connected to the framework 12 and the other end to an arm 106 which is held in contact with the lower surface of the guide plate 14 by the spring 102, when a sheet 22 is not being fed by the feeding structure 10. The arm 106 includes an end portion 108 which extends toward and downwardly of the direction of travel 22 of a sheet 24 fed to the apparatus 10.

The apparatus 10 (FIG. 1) may also include conventional edge registration structure 110, including a guide deck 112 which is suitably fixedly connected to the framework 12. The guide deck 112 has a flat upper surface 114 for receiving respective sheets and envelopes 24 to be fed to the feeding structure 40, and includes a front edge 116. In addition, the registration structure 110 includes a suitable edge registration fence 118, against which an edge 120 of a given sheet or envelope 24 may be urged. Preferably, the fence 118 is conventionally movably connected to the guide deck 112 and suitably adapted to be fixedly positioned in any selected location relative to the front edge 116 of the guide deck 112 for providing a reference surface against which various widths of sheets and envelopes may be registered while being fed downstream to the feeding structure 40. For feeding purposes, the registration structure 110 may include one or more, and preferably at least two, driven rollers 120 which are axially disposed for rotation at an angle relative to the length of the registration fence 118 and conventionally connected to the source of supply of motive power 50 for driving thereby.

The apparatus 10 may also include conventional reading or writing structure 130 for on the one hand reading information marked on the upper surfaces of respective sheets and envelopes 24 exposed through the guide plate aperture 34, and on the other hand writing information on the upper surfaces of such sheets and envelopes 24, as they are respectively fed downstream by the feeding structure 40. Without departing from the spirit and scope of the invention, the reading structure may be any conventional optical character reading structure, whereas the writing structure 130 may be any conventional ink jet printing structure.

Figure 2:
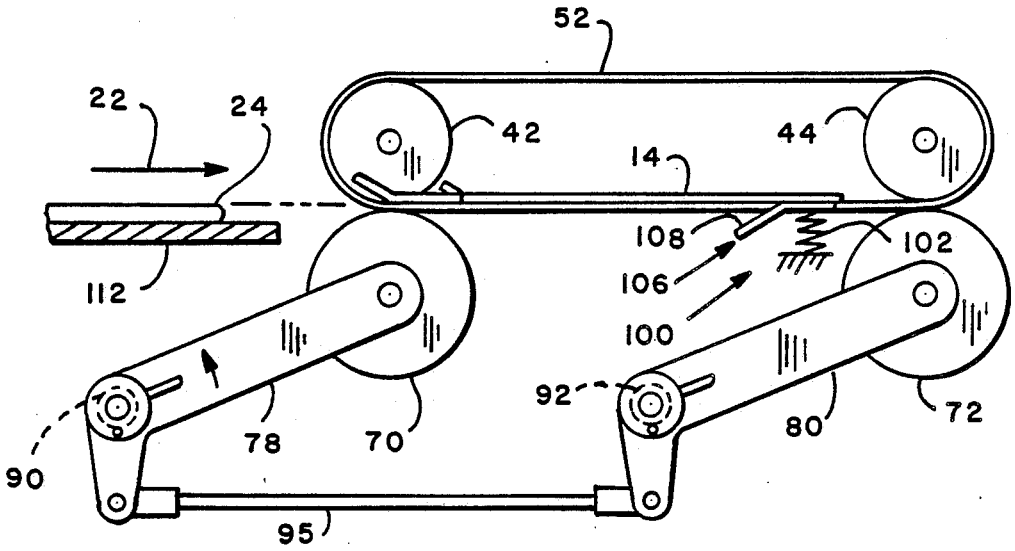
FIG. 2 is a schematic view of the apparatus of FIG. 1, showing an envelope being fed thereto.

As shown in FIG. 2, the registration deck 112 lies in a plane below the lower surface of the guide plate 14. In practice, the vertical distance between the upper surfaces of the edge registration deck and guide plate is approximately three-eights of an inch, which distance corresponds to substantially the thickness of the thickest stuffed envelope or mailpiece 24 which may be processed by the apparatus 10. Thus, the upper surface of one of the thickest of such envelopes 24 lies in the same plane as the lower surface of the guide plate 14.

Figure 3:
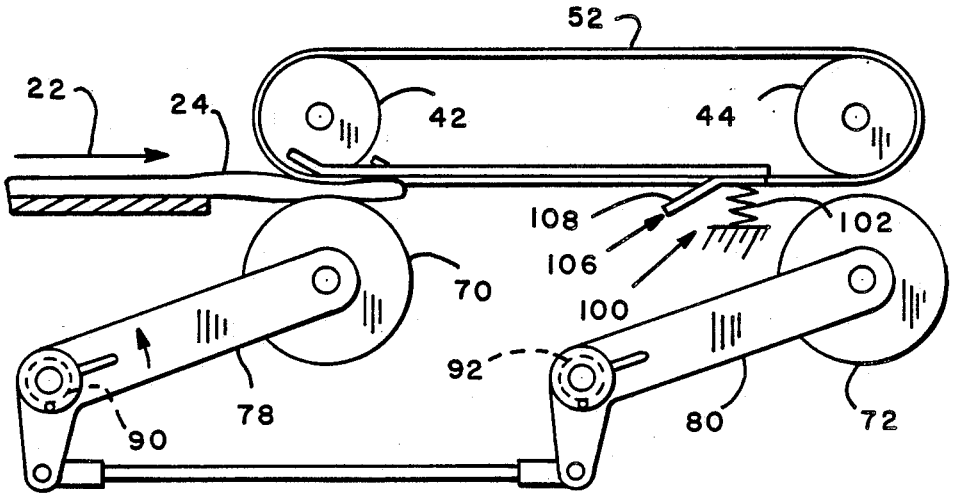
FIG. 3 is a schematic view of the apparatus, of FIG. 1, showing an envelope being transported by the apparatus.
Figure 5:
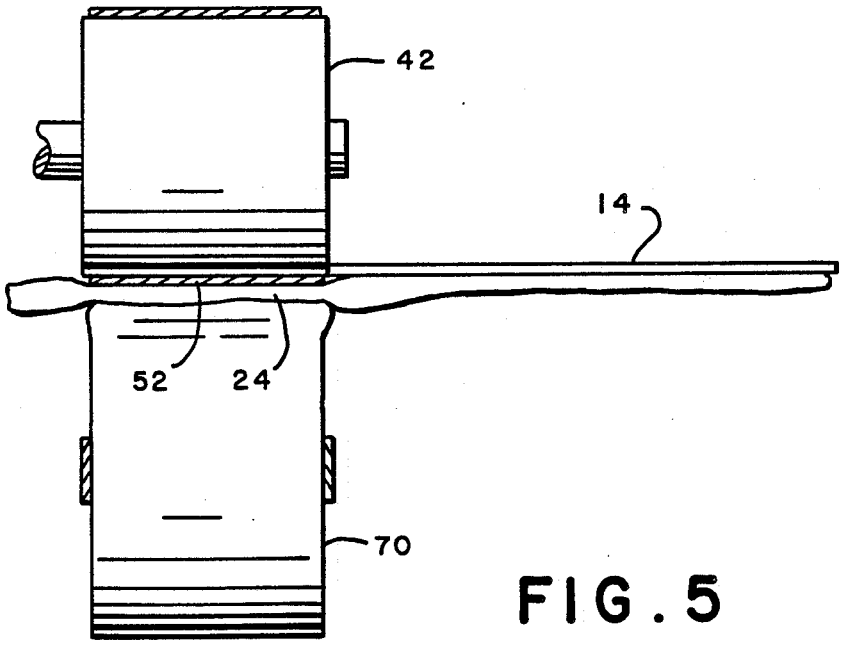
FIG. 5 is a schematic input end view of FIG. 3 showing a stuffed envelope being fed by the apparatus.

As shown in FIGS. 3 and 5, assuming a relatively thick stuffed envelope or mailpiece 24 engaged by the feeding structure 40, the forward compliant roller 70 engages and squeezes the stuffed envelope 24 between the belt 24 and compliant roller 70, and the roller 70 is compressed and urged downwardly against the resilient force applied to the roller 70 by the coil spring 90 (FIG. 1), with the result that the portion of the stuffed envelope 24 underlying the forward portion 60 FIG. 1 of the guide plate 14 tends to bulge upwardly FIG. 5 and into contact with the lower surface of the guide plate 14 as the belt 52 feeds the envelope 24 downstream beneath the guide plate 14. As a result, the upper surface of the moving envelope 24 is disposed in a predetermined, desired path of travel, which is coincident with a plane defined by the lower, flat surface 18 of the guide plate 14, while being fed past the plate aperture 34 by the belt 52.

Figure 4:
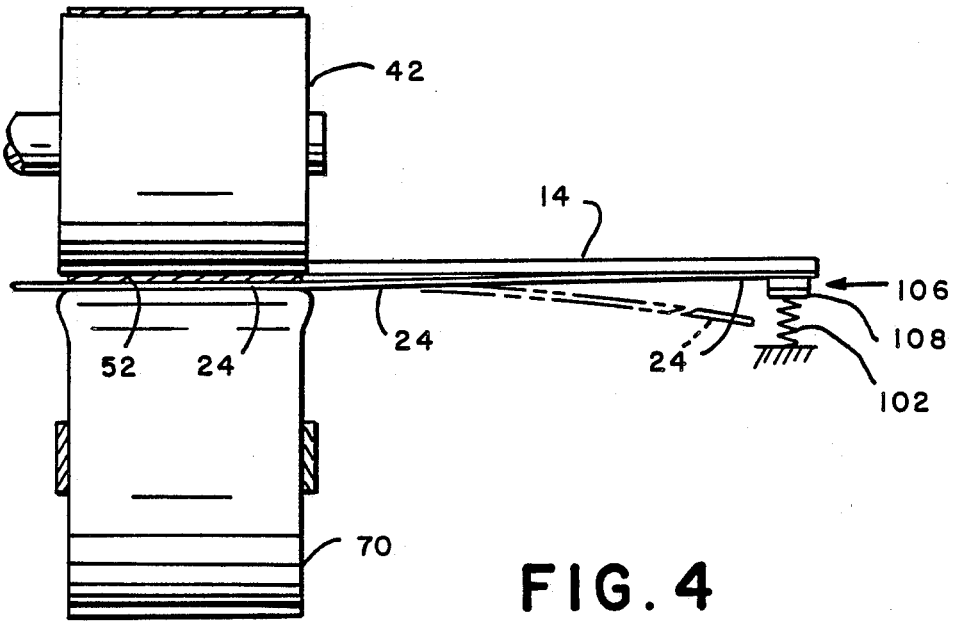
FIG. 4 is a schematic input end view of FIG. 3 showing a sheet being fed by the apparatus.

On the other hand, as shown in FIG. 4, when a substantially flat sheet or envelope 24 is being fed by the feeding structure 40, although it is urged upwardly towards the lower surface 18 of the guide plate 14 and tends to contact the same, the outwardly extending edge of the sheet 24 tends to droop downwardly and thus away from the guide plate aperture 34 while being fed past the same. To counteract this effect the spring structure 100 is located near the plate aperture 34 for engagement by a moving sheet 24 to deflect the same towards the guide plate 14 and hold the moving sheet 24 in contact with the lower surface of the guide plate 14, thereby to ensure that the upper surface of the sheet is held in contact with the lower surface of the guide plate 14 as the feeding structure 40 feeds the sheet 24 past the plate aperture 34.

In view of the foregoing, it is noted that sheets, envelopes which are not stuffed with more than a single sheet of flattened light-weight stationery, postcards, and comparable sheets, letters and mailpieces, which, for the purposes of this disclosure are individually and collectively called sheets, have a tendency to droop downwardly near the front edge of the guide plate 14 as they are fed by the feeding structure 40 of the apparatus 10. As a result of which the aforesaid spring structure 100 is preferably included in the apparatus 10 to ensure that such sheets 24 are urged into engagement with the lower surface of the guide plate 14, and thus into the aforesaid predetermined path of travel, as they are fed past the guide plate aperture 34. On the other hand, envelopes which are stuffed with one or more folded sheets of stationery, self-mailing types of folded mailpieces, and comparable stuffed letters and mailpieces, which, for the purpose of this disclosure are individually and collectively called letters, are adapted to be squeezed as hereinbefore discussed and tend to deflect when squeezed by engagement of the belt 52 and either or both of the compliant rollers 70, 72 of the apparatus 10. As a result of which the aforesaid spring structure 100 need not, but may be, included in the apparatus 10, since such letters tend to be urged, without the provision of the spring structure 100 into engagement with the lower surface of the guide plate 14, and thus into the aforesaid predetermined path of travel, as they are fed past the guide plate aperture 34.

As shown in FIG. 3, when the sheets and letters 24 are engaged by the feeding structure 40, between the belt 52 and compliant roller 70, the roller 70 and its associated yoke 78 are urged downwardly against the force exerted on the sheets or letters 24 by the compliant roller and spring 90. Since the yoke 78 is interconnected to the yoke 80 by the tie rod 95 the yoke 80 and associated compliant roller 72 is also lowered, in unison with the lowering of the yoke 78 and roller 70, against the force exerted by the spring 92. As a result, the compliant roller 72 is vertically spaced below the guide plate before the sheet or letter 24 received by the feeding structure engages the roller 72. With this arrangement downstream movements of the sheet or letter 24 is not braked when it engages the roller 72 and the belt portion located directly above the roller 72, as a result of which the reading accuracy and writing quality are not effected by such engagement.

In accordance with the objects of the invention there has been disclosed sheet and envelope processing apparatus which is particularly suitable for use in transporting sheets, and stuffed envelopes, including mailpieces, in a predetermined path of travel for reading and writing information thereon.

What is claimed is:

1. Apparatus for transporting a sheet in a predetermined path of travel, the apparatus comprising:

a. a plate having a lower surface extending parallel to and defining the path of travel, the plate including an aperture;

b. sheet feeding means including a first pair of rollers spaced apart from one another and an endless belt looped about the first rollers, the belt having a lower belt run extending between the first rollers and beneath the plate, the feeding means including means for driving one of the first rollers for moving the lower belt run in the direction of the path of travel, the feeding means including a second pair of rollers disposed beneath the plate, each of the second rollers being made of a compliant material, the feeding means including means for resiliently urging the compliant rollers toward the path of travel for urging a sheet feed to the apparatus into contact with the belt and the lower surface of the plate, whereby the belt engages and feeds the sheet with a portion thereof in the path of travel when fed past the aperture, and the resilient urging means including means for connecting the compliant rollers to one another for movement in unison with one another toward and away from the plate.

2. The apparatus according to claim 1, wherein the connecting means includes a tie rod.

3. The apparatus according to claim 1, wherein the second pair of rollers is disposed beneath the belt for engagement therewith when the belt is not in engagement with a sheet whereby the second pair of rollers is driven by the belt when the belt is not moving a sheet.

4. The apparatus according to claim 1, wherein the driving means is adapted for driving said at least one roller and thus the belt and a sheet engaged thereby at a constant velocity.

5. The apparatus according to claim 1, wherein a moving sheet in the path of travel moves in overlapping relationship with respect to the aperture, whereby the top surface of the moving sheet is exposed through the aperture.

6. The apparatus according to claim 1 including spring means, and the spring means including a member located for engagement with a marginal edge of a sheet in the course of movement of a sheet by the belt.

7. Apparatus for transporting a sheet in a predetermined path of travel, the apparatus comprising:

a. a plate having a lower surface extending parallel to and defining the path of travel, the plate including an aperture;

b. sheet feeding means including a first pair of rollers spaced apart from one another and an endless belt looped about the first rollers, the belt having a lower belt run extending between the first rollers and beneath the plate, the feeding means including means for driving one of the first rollers for moving the lower belt run in the direction of the path of travel, the feeding means including a second pair of rollers disposed beneath the plate, a pair of bifurcated supports rotatably supporting the second pair of roller, each of the second rollers being made of a compliant material, the feeding means including means for resiliently urging the compliant rollers toward the path of travel for urging a sheet feed to the apparatus into contact with the belt and the lower surface of the plate, whereby the belt engages and feeds the sheet with a portion thereof in the path of travel when fed past the aperture, and means for interconnecting the bifurcated supports for movement thereof in unison with one another, whereby the compliant rollers move toward and away from the path of travel in unison with one another.

8. The apparatus according to claim 7, wherein the second pair of rollers is disposed beneath the belt for engagement therewith when the belt is not in engagement with a sheet whereby the second pair of rollers is driven by the belt when the belt is not moving a sheet.

9. The apparatus according to claim 7, wherein the driving means is adapted for driving said at least one roller and thus the belt and a sheet engaged thereby at a constant velocity.

10. The apparatus according to claim 7, wherein a moving sheet in the path of travel moves in overlapping relationship with respect to the aperture, whereby the top surface of the moving sheet is exposed through the aperture.

11. The apparatus according to claim 7 including spring means, and the spring means including a member located for engagement with a marginal edge of a sheet in the course of movement of a sheet by the belt.

12. Apparatus for transporting a letter, the apparatus comprising:

a. a plate having a lower surface extending parallel to and defining a predetermined path of travel, the plate including an aperture;

b. letter feeding means including a first pair of rollers spaced apart from one another and an endless belt looped about the first rollers, the belt having a lower belt run extending between the first rollers and beneath the plate, the feeding means including means for driving one of the first rollers for moving the lower belt run in the direction of the path of travel, the feeding means including a second pair of rollers disposed beneath the plate, each of the second rollers being made of a compliant material, the feeding means including means for resiliently urging the compliant rollers toward the path of travel for urging a letter fed to the apparatus into contact with the belt and the lower surface of the plate, whereby the belt engages and feeds the sheet with a portion thereof in the path of travel when fed past the aperture, and the resilient urging means including means for connecting the compliant rollers to one another for movement in unison with one another toward and away from the plate.

13. The apparatus according to claim 12, wherein the connecting means includes a tie rod.

14. The apparatus according to claim 12, wherein the second pair of rollers is disposed beneath the belt for engagement therewith when the belt is not in engagement with a letter whereby the second pair of rollers is driven by the belt when the belt is not moving a letter.

15. The apparatus according to claim 12, wherein the driving means is adapted for driving said at least one roller and thus the belt and a letter engaged thereby at a constant velocity.

16. The apparatus according to claim 12, wherein a letter in the path of travel moves in overlapping relationship with respect to the aperture, whereby the top surface of the moving letter is exposed through the aperture.

17. The apparatus according to claim 12 including spring means, and the spring means including a member located for engagement with a marginal edge of a letter in the course of movement of a letter by the belt.

18. Apparatus for transporting a letter, the apparatus comprising:

a. a plate having a lower surface extending parallel to and defining a predetermined path of travel, the plate including an aperture;

b. letter feeding means including a first pair of rollers spaced apart from one another and an endless belt looped about the first rollers, the belt having a lower belt run extending between the first rollers and beneath the plate, the feeding means including means for driving one of the first rollers for moving the lower belt run in the direction of the path of travel, the feeding means including a second pair of rollers disposed beneath the plate, a pair of bifurcated supports rotatably supporting the second pair of rollers, each of the second rollers being made of a compliant material, and the feeding means including means for resiliently urging the compliant rollers toward the path of travel for urging a letter fed to the apparatus into contact with the belt and the lower surface of the plate, whereby the belt engages and feeds the sheet with a portion thereof in the path of travel when fed past the aperture, and means for interconnecting the bifurcated supports for movement thereof in unison with one another, whereby the compliant rollers move toward and away from the path of travel in unison with one another.

19. The apparatus according to claim 18, wherein the second pair of rollers is disposed beneath the belt for engagement therewith when the belt is not in engagement with a letter whereby the second pair of rollers is driven by the belt when the belt is not moving a letter.

20. The apparatus according to claim 18, wherein the driving means is adapted for driving said at least one roller and thus the belt and a letter engaged thereby at a constant velocity.

21. The apparatus according to claim 18, wherein a letter in the path of travel moves in overlapping relationship with respect to the aperture, whereby the top surface of the moving letter is exposed through the aperture.

22. The apparatus according to claim 18 including spring means, and the spring means including a member located for engagement with a marginal edge of a letter in the course of movement of a letter by the belt.

* * * * *